US006336594B1

(12) United States Patent
Bader et al.

(10) Patent No.: US 6,336,594 B1
(45) Date of Patent: Jan. 8, 2002

(54) LARGE SCALE POSITIVE PRESSURE VENTILATION MACHINE

(76) Inventors: Jurgen Bader, Gustav-Freytag-Strasse 21, D-89537 Giengen (DE); Leroy B. Coffman, II, 258 W. Bluff, Fresno, CA (US) 93911

( * ) Notice: Subject to any disclaimer, the term of this patent is extended or adjusted under 35 U.S.C. 154(b) by 0 days.

(21) Appl. No.: 09/566,228

(22) Filed: May 5, 2000

Related U.S. Application Data

(63) Continuation of application No. 09/175,207, filed on Oct. 19, 1998.

(30) Foreign Application Priority Data

Oct. 22, 1997 (DE) ..... 297 18 954 U

(51) Int. Cl.[7] ..... A62C 8/00; A62C 25/00; A62C 39/00; B05B 9/06

(52) U.S. Cl. ..... 239/54; 169/48; 169/52; 169/91; 239/77

(58) Field of Search ..... 169/54, 52, 48, 169/91; 239/587.6, 281, 289, 77; 415/131, 129, 132, 220, 221, 219.1; 248/130, 133, 145, 141, 137, 131

(56) References Cited

U.S. PATENT DOCUMENTS

| | | | |
|---|---|---|---|
| 667,149 | A | 1/1901 | Kenney |
| 1,351,700 | A | 8/1920 | Smith |
| 1,849,411 | A | 3/1932 | Silva |

(List continued on next page.)

FOREIGN PATENT DOCUMENTS

| | | |
|---|---|---|
| EP | 0386883 A2 | 9/1990 |
| GB | 181283 | 6/1922 |
| GB | 2109102 A | 5/1983 |
| GB | 5073 | 12/1989 |

OTHER PUBLICATIONS

Tempest Controlled Airstreams Presents the MVU Mobile Ventilation Unit (circa 1996).

Tempest Controlled Airstreams, MVU (Mobile Ventilation Unit) Brochure circa Jun., 1994.

Tempest Controlled Airstreams, MVU (Mobile Ventilation Unit) Brochure.

*Primary Examiner*—David A. Scherbel
*Assistant Examiner*—Davis Hwu
(74) *Attorney, Agent, or Firm*—Mark D. Miller

(57) ABSTRACT

Disclosed is a large scale mobile positive pressure blower designed to provide positive pressure ventilation for fighting fires in large spaces such as tunnels, mines, halls, warehouses large Box stores, high-rise buildings, shopping malls and the like. In accordance with the invention, a hydraulically or electrically operated ventilation blower is provided on an adjustable elevation device that may be mounted either on a movable vehicle or trailer, or in stationary locations in the vicinity of a structure opening or portal. The blower delivers a large volume of air having a conical shape into an opening at one end of the structure (e.g. a transportation tunnel) to force the smoke and hazardous gasses out through a different opening. One or more blowers may be used, depending upon the size of the entrance and the structure. This allows the fire fighters to enter the structure at the entrance where the blower has been deployed with the wind at their backs, enabling them to easily view and extinguish the fire and to locate survivors. In an alternative embodiment, one or more blowers may be attached to movable support(s) fixedly mounted near an entrance to a structure so that the blower(s) can be easily positioned for ventilation, and moved out of the way when not in use. Other alternative embodiments include blower attachments such as water spray nozzles, fog-forming mist emitters, and illumination means.

16 Claims, 7 Drawing Sheets

U.S. PATENT DOCUMENTS

| | | | | | |
|---|---|---|---|---|---|
| 1,871,096 | A | | 8/1932 | Torseth | |
| 1,926,298 | A | | 9/1933 | Moore | |
| 2,190,945 | A | | 2/1940 | Guth | 230/120 |
| 2,855,497 | A | | 10/1958 | Bacon | 169/91 |
| 2,891,624 | A | | 6/1959 | McBride | 169/91 |
| 3,128,036 | A | | 4/1964 | McBride | |
| 3,212,604 | A | | 10/1965 | Garnett | |
| 3,552,652 | A | * | 1/1971 | Greenwood | 239/77 |
| 3,664,459 | A | | 5/1972 | Stephens | |
| 3,675,721 | A | | 7/1972 | Davidson | |
| 3,944,139 | A | * | 3/1976 | Butler | 239/77 |
| 4,049,363 | A | | 9/1977 | Bauman et al. | 416/157 |
| 4,311,198 | A | | 1/1982 | Vasquez | |
| 4,875,526 | A | | 10/1989 | Latino et al. | 169/24 |
| 5,037,029 | A | * | 8/1991 | Garet et al. | 239/77 |
| 5,062,487 | A | | 11/1991 | Siria et al. | 169/91 |
| 5,122,034 | A | * | 6/1992 | Isert | 416/167 |
| 5,297,653 | A | | 3/1994 | Wurtz | |
| 5,305,548 | A | | 4/1994 | Siebol | 239/77 |

* cited by examiner

LARGE SCALE POSITIVE PRESSURE VENTILATION MACHINE

This is a continuation of U.S. Ser. No. 09/175,207, filed Oct. 19, 1999.

BACKGROUND OF THE INVENTION

1. Field of the Invention

The present invention relates to positive pressure ventilation, and more particularly to a new and improved method and apparatus for providing positive pressure ventilation on a large scale.

2. Description of the Prior Art

Positive pressure ventilation is a fire fighting technique which is used to remove smoke and provide ventilation to burning structures. Small scale portable blowers such as that disclosed in U.S. Pat. No. 4,906,164 have been designed to be able to quickly evacuate smoke from a burning building. This decreases the potential for smoke damage, and improves visibility and breathing for fire fighters so that they may more efficiently and safely fight the fire.

Larger scale blowers have been developed for fighting outdoor grass or forest fires, such as those disclosed in U.S. Pat. Nos. 1,849,411 and 1,871,096. However, these inventions provide only a general flow of air, and usually accomplish little more than moving smoke away from a small area. Similar devices have been developed for suction of smoke and hot air from burning buildings, such as those described in U.S. Pat. Nos. 1,351,700 and 1,926,298. However, these devices can be severely damaged by the constant flow of smoke and hot air that passes through them.

A mobile wind-generating machine has been developed for use in creating a large-volume stream of air for blowing back forest fires, providing evaporation in orchards, and/or simulating storms on a motion picture set in U.S. Pat. No. 3,128,036. However, this wind-generating machine suffers from several drawbacks which prevent it from optimal use in positive pressure ventilation. Among other things, the machine is powered by an internal combustion engine which is located directly in the path of the incoming air to the machine. This location tends to disrupt and restrict the flow of air through the machine. An internal combustion engine also severely limits the maximum speed as well as the range of speeds of the blower, thereby limiting the output airflow. Also, while the flow of air through the machine is streamlined, the output is not concentrated in a conical shape as preferred in positive pressure ventilation.

In the event of a vehicle fire, gas leak or terrorist attack occurring in the middle of a large structure such as a tunnel, the positive pressure ventilation fire fighting technique calls for blowing a large volume of air into one end of the tunnel to force the smoke and hazardous gasses out through the other end, or through ventilation ports. This allows the fire fighters to enter the tunnel at the entrance where the blower has been deployed with the wind at their backs, enabling them to easily see and extinguish the fire and to locate survivors. A small blower would be inadequate to move the required volume of air, and there is no large scale blower particularly adapted to accomplish the needs of positive pressure ventilation (e.g. compensating for any inclination of the road leading to the tunnel, etc.). In particular, existing blowers do not provide a sufficiently wide range of positioning adjustability or air velocity adjustability, S nor do they concentrate a sufficient amount of air in the desired conical shape in order to completely cover the tunnel entrance for positive pressure ventilation.

SUMMARY OF THE INVENTION

The present invention is a large scale positive pressure blower designed to provide positive pressure ventilation of large (enclosed) spaces such as tunnels, mines, halls, warehouses, large Box stores, high-rise buildings, shopping malls and the like. In accordance with the invention, a hydraulically or electrically operated ventilation blower is provided on an adjustable elevation device that may be mounted either on a movable vehicle or trailer, or in a stationary location in the vicinity of structure openings or portals. The vehicle or trailer mounted embodiment of the invention may be made available on a scaffold, scissor lift, telescopic lift, hydraulic lift or other suitable elevating device, allowing for simple and easy vertical positioning of the blower.

The blower has a generally cylindrical overall configuration, and is pivotally mounted to and supported by a pair of arms, one on either side, allowing the blower to be tilted up or down over a horizontal axis. The support arms are attached to a rotatable swivel mount, allowing the blower to be rotated in a circular arc around a vertical axis. This pivotal support of the blower on a rotatable mount provides a wide range of different positioning alternatives for the blower, allowing the output airflow to be aimed in a precise direction in order to optimize use in a positive pressure ventilation situation.

The blower produces a conical stream of air which is designed to be aimed towards a portal or opening in a space to be ventilated (such as a transportation tunnel) and which completely covers the opening. Such complete coverage is necessary in order to accomplish the objective of positive pressure ventilation by forcing the air inside the space to exit through another, different opening (e.g. the other end of the tunnel), and preventing it from returning back through the air flow entrance.

Inside the cylindrical blower housing or shroud, a plurality of adjustably angled blades or vanes are provided in radial relationship to a rotatable center. Rotation of the center and blades forces air through the cylinder. The center and the blades are designed for extremely high rotation speeds in order to generate very large volumes of moving air. In the preferred embodiment, this rotation is provided hydraulically thereby providing an infinitely variable speed control of the blower. Hydraulics may also be used to operate the lift, swivel and pivot for positioning the blower. In such a case, a single hydraulic system may be used to control all of these moving parts. Alternatively, the blower may be powered using a conventional electric or fuel powered motor using either direct or belt drive.

In alternative embodiments, the blower cylinder may be equipped with one or more of the following attachments: (1) water spray nozzles which enable the blower to be used to cool objects, extinguish fires, and secure task forces; (2) water mist emitters which allow water vapor to be mixed with the air stream flowing from the blower (fog) for the same purposes as the nozzles; and/or (3) illumination apparatus for use under low visibility or at night.

In the vehicle or trailer mounted embodiment, the swivel support is attached to a vertical lift which may also be powered by the same hydraulic system as the other hydraulically operated parts. In this embodiment, the vehicle or trailer is transported to a location outside the area to be ventilated. The blower is raised by the lift to a suitable height, and is then adjusted using the horizontal tilt and rotatable swivel for precise positioning of the blower in order for the air stream to completely cover an opening in the space to be ventilated.

The stationary embodiment of the invention is designed to be attached to a mount near an opening in a large area that may require positive pressure ventilation in the event of a fire. For example, the invention may be attached to a mount on the outside of a tunnel portal. The blower in this embodiment uses the same cylindrical structure pivotally mounted on a rotatable swivel as described above. The swivel, in turn, is attached to a mount having the ability to raise and lower the blower in order to properly position it in front of the opening for positive pressure ventilation, and to move it aside when not in use. Such positioning may be accomplished in a variety of ways, including a movable boom, a sectional or elbow lift, a crane, a knuckle arm, a scissor lift, a telescoping lift or the like.

A plurality of blowers may be employed to provide a sufficient volume of air to evacuate a large building such as an aircraft hangar. In such a situation, the air flow from each of the blowers is directed at a single building entrance. Such blowers may be placed side by side to provide broad coverage to the building entrance, one in front of another to increase air velocity, or both for both effects. One or more stationary (i.e. non-vehicle mounted) blowers may be fixedly placed near the entrances of such buildings for preventative purposes where the need for positive pressure ventilation may arise.

The conical air flow of the blower is formed through the interaction of the cylindrical housing and the rotating blades therein. The longer the distance between the blades and the exit from the housing the more narrow and more focused the cone of exiting air. Increasing the RPM of the blades also forms a better cone of air for direction at an opening in the structure.

It is therefore a primary object of the present invention to provide a portable positive pressure ventilation blower for use in fighting fires associated with large structures such as tunnels, mines, halls, warehouses, large Box stores, high-rise buildings, shopping malls and the like.

It is also an important object of the invention to provide a positive pressure ventilation blower which is capable of delivering a large volume of air over a widely variable velocity range using a specially designed hydraulically driven blower system.

It is a further object of the present invention to provide a portable positive pressure ventilation blower which is capable of delivering a large volume of air in a concentrated stream having a conical shape in order to provide ventilation on a very large scale.

It is a further object of the present invention to provide a portable positive pressure ventilation blower which may be positioned over a wide range of alternatives, allowing the output airflow to be aimed in a precise direction in order to optimize use in a positive pressure ventilation situation.

It is another object of the present invention to provide a stationary positive pressure ventilation blower for available use in fighting fires that is mounted near an entrance to a large structure such as a tunnel, mine, hall, warehouse or the like.

It is another object of the present invention to provide a stationary positive pressure ventilation blower equipped with spray nozzles and/or mist emitters for use in cooling objects, extinguishing fires, and assisting fire fighting forces.

Additional objects of the invention will be apparent from the detailed descriptions and the claims herein.

DETAILED DESCRIPTION OF THE PREFERRED EMBODIMENTS

Figure 1:
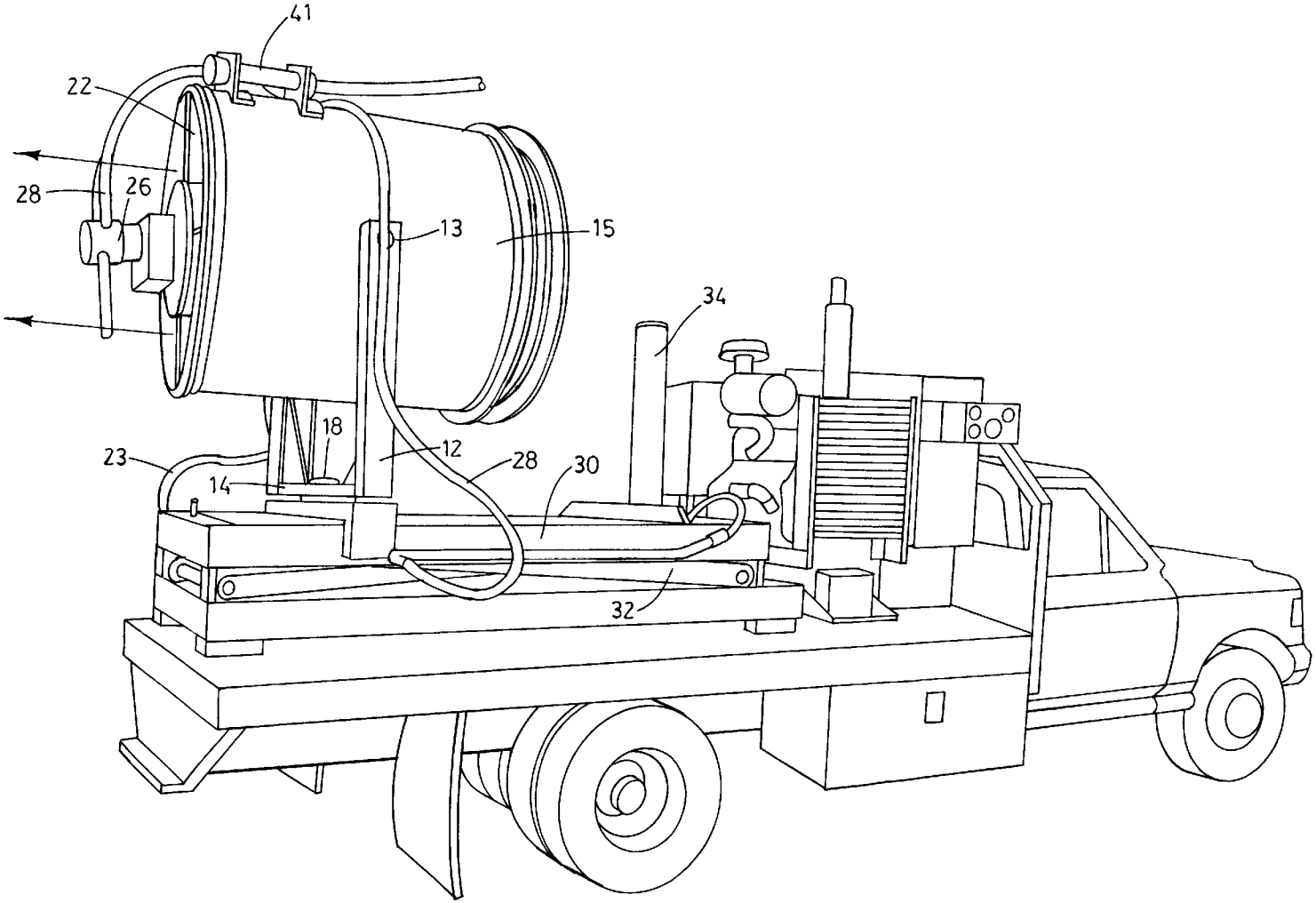
FIG. 1 is a perspective view of the vehicle mounted version of the present invention showing the blower, lift and hydraulic system.
Figure 2:
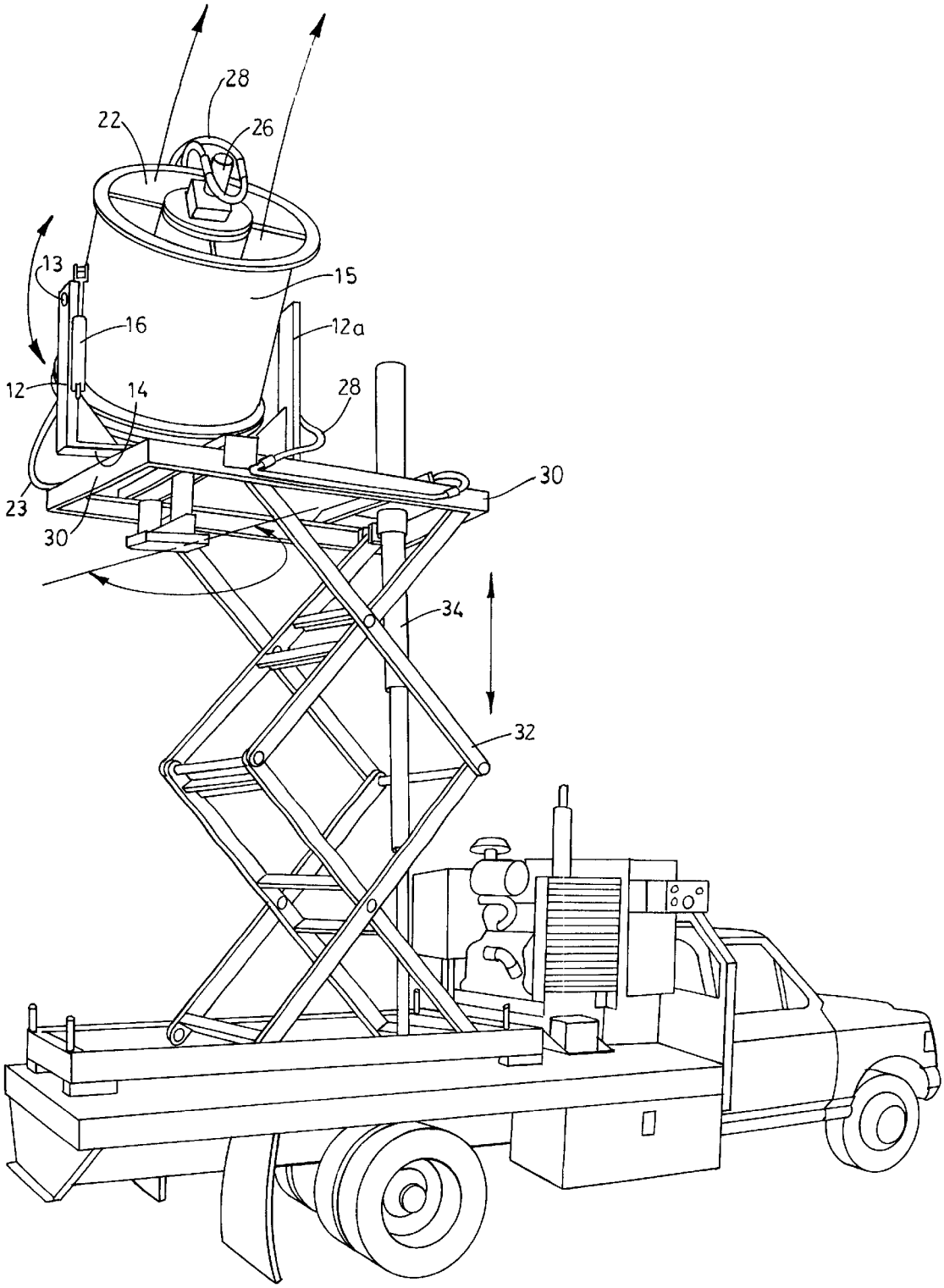
FIG. 2 is a perspective view of the vehicle mounted version of the present invention showing the lift having moved the blower to an elevated position, the blower itself having been rotated along a vertical axis and tilted up from a horizontal axis.
Figure 3:
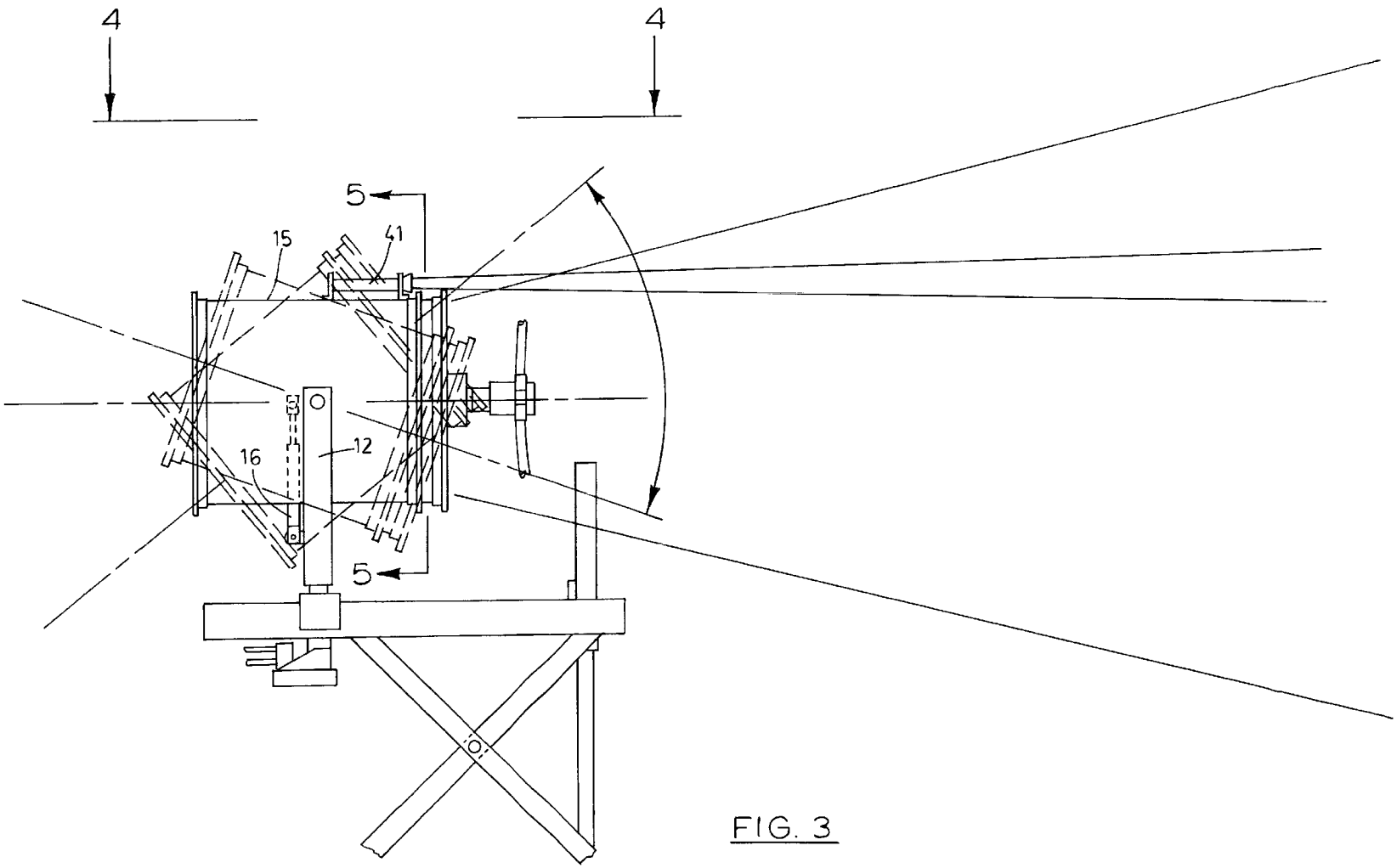
FIG. 3 is a side elevational view of the blower showing a range of alternative positions tilted from horizontal, and the resulting air flow direction.
Figure 4:
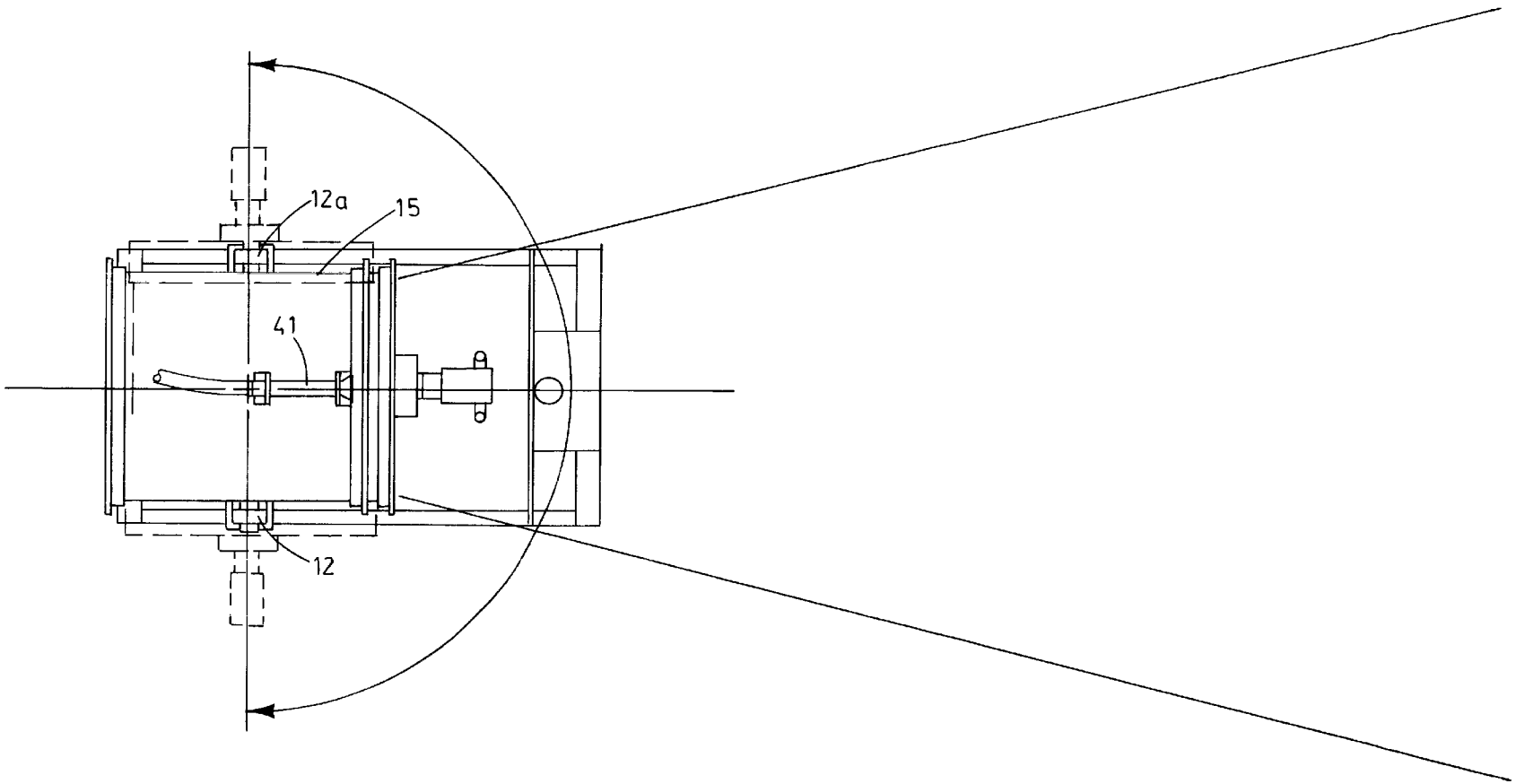
FIG. 4 is a top view of the blower along line 4—4 of FIG. 3, showing a range of alternative positions rotating around a vertical axis, and the resulting air flow direction.
Figure 5:
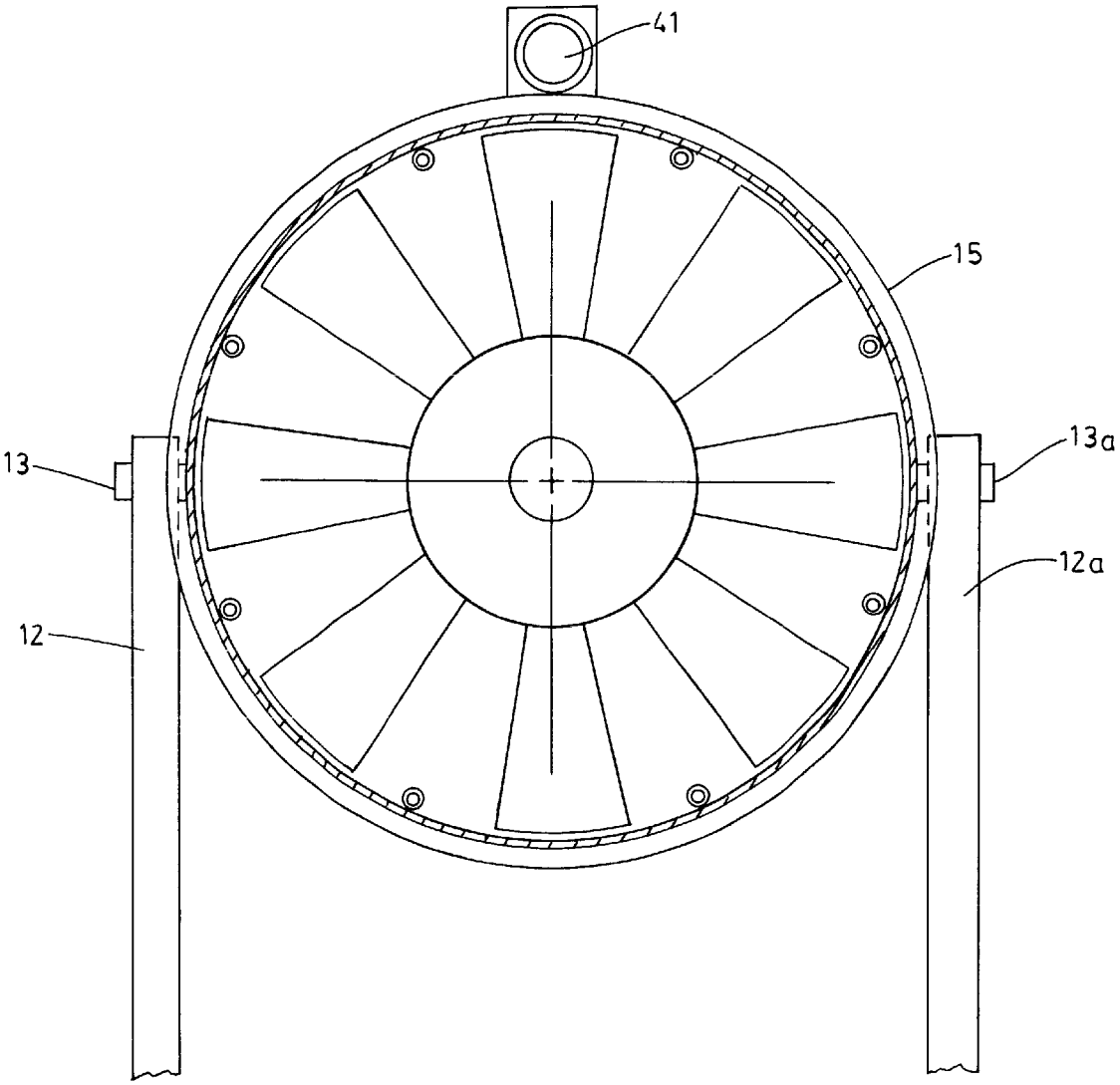
FIG. 5 is a front view of the blower along line 5—5 of FIG. 3.

Referring to the drawings wherein like reference characters designate like or corresponding parts throughout the several views, and referring particularly to FIGS. 1 and 2 it is seen that the invention includes a cylindrical housing 15 pivotally supported by arms 12, 12*a* at pivots 13, 13*a*. A transverse member 14 connects arms 13, 13*a* forming a U-shaped configuration whereby the horizontal tilt axis passes through the two arms along pivot 13, 13*a*. Movement of housing 15 is accomplished via hydraulic member 16 as shown in FIG. 3. Hydraulic fluid is delivered to member 16 through hose 23. Member 14 is attached to swivel mounted pivot 18 which rotates in an arcuate path as shown in FIG. 4. Accordingly, horizontal and vertical movement of cylinder 15 may be accomplished as shown in FIG. 2.

A plurality of angled vanes or blades 22 are provided in radial relationship to a rotatable central member 24 inside cylinder 15. Although four blades 22 are shown in the illustrations, any suitable number of blades may be utilized. Rotation of member 24 is accomplished using hydraulic pressure delivered to engine 26 through hose 28. Adjusting the hydraulic pressure delivered through hose 28 allows adjustment of the speed of engine 26 and hence adjustment of the velocity and volume of air that is forced through cylinder 15 by blades 22. Because the system is hydraulically powered, a wide range of fine speed adjustment is available. The size of the cross-sectional coverage of the conically shaped air output may be changed by adjusting the positions of the blades 22 in relation to the exit from housing cylinder 15.

Figure 6:
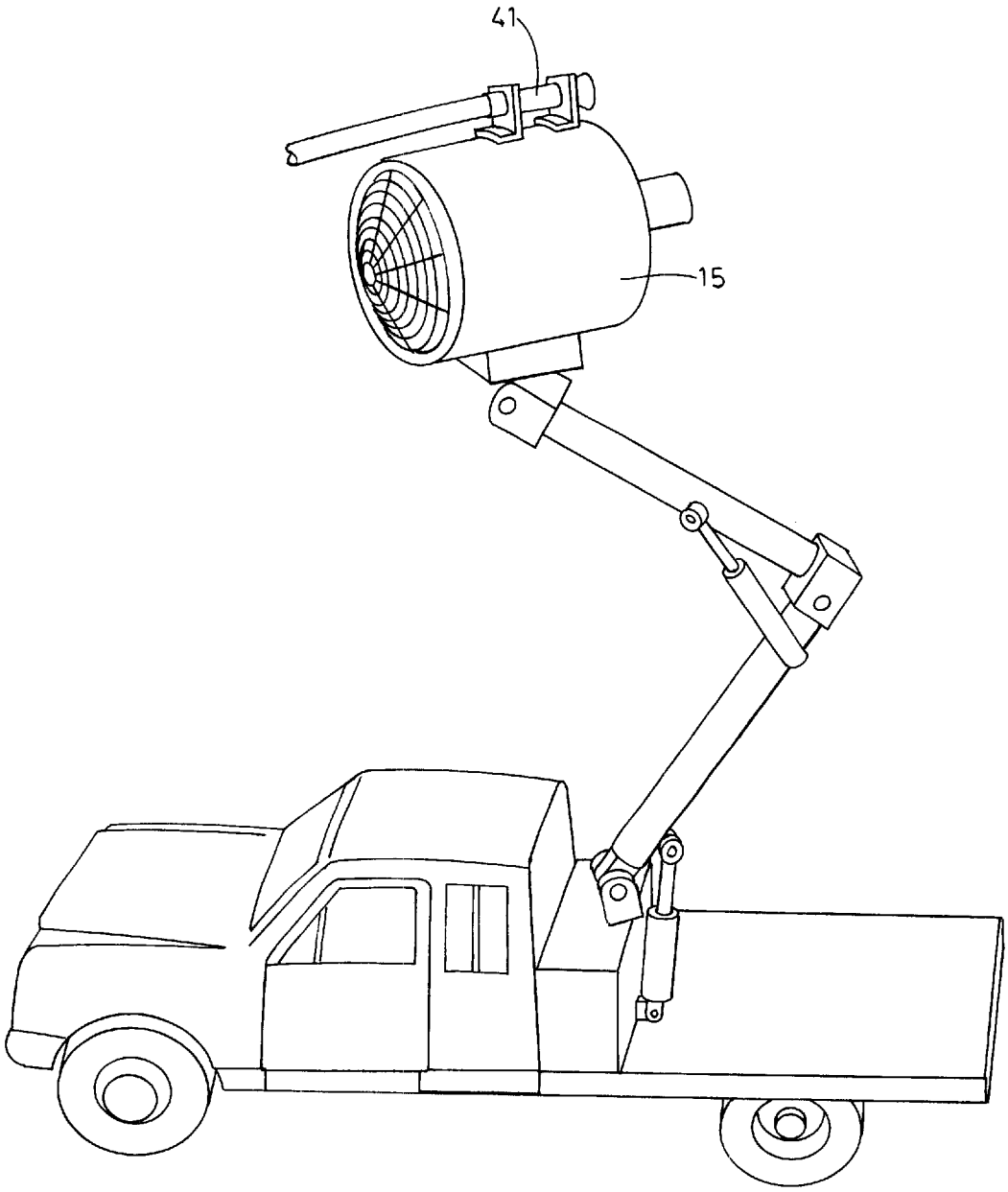
FIG. 6 is a perspective view of an alternative embodiment of the invention showing a hydraulic elbow crane lift support.
Figure 7:
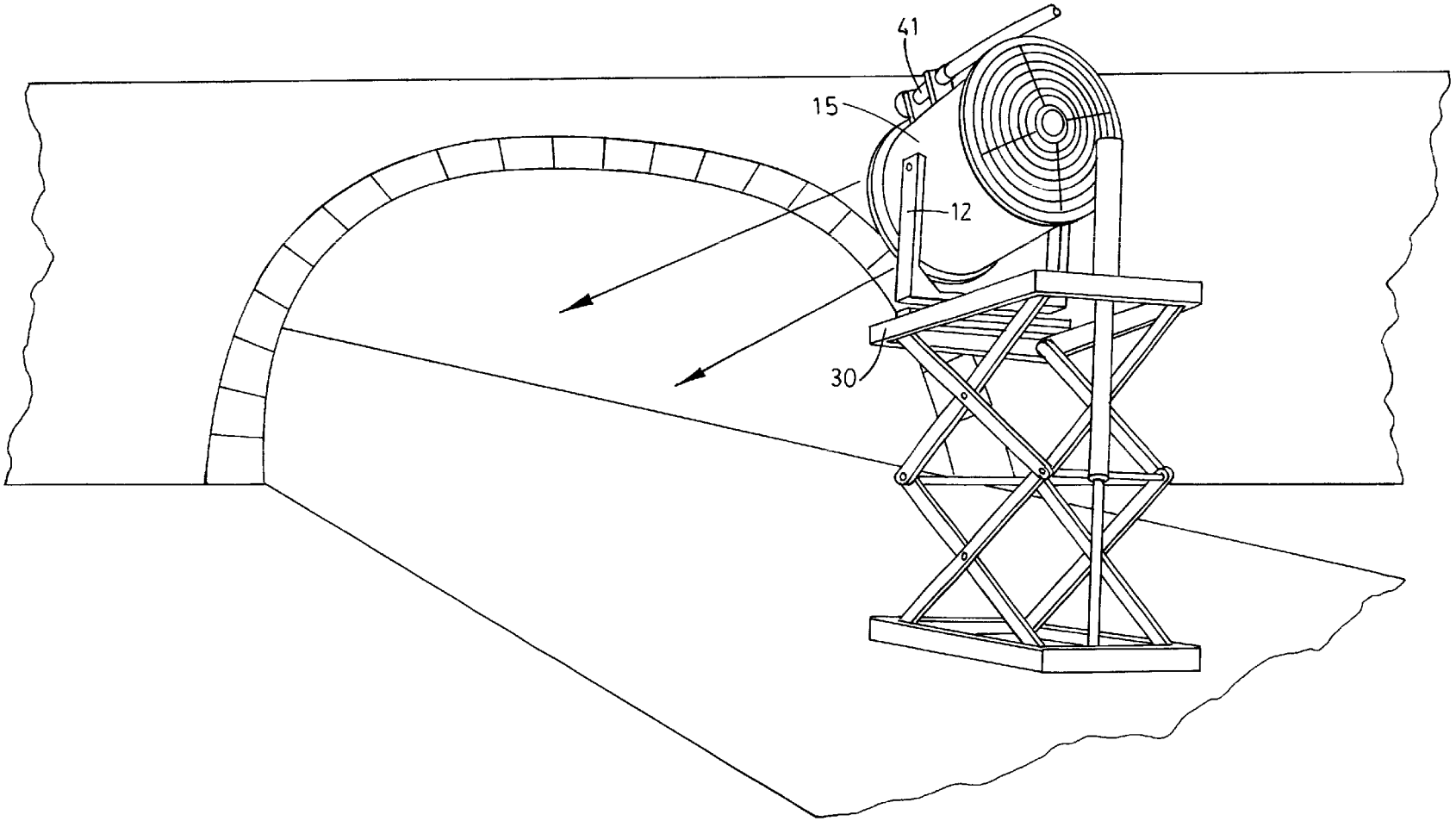
FIG. 7 is a perspective view of an alternative stationary embodiment of the invention placed in front of a tunnel.

Swivel 18 is pivotally attached to platform 30 which may be supported by scaffold 32 as shown in FIGS. 1 and 2. In this embodiment, telescoping hydraulic lift 34 is used to raise and lower scaffold 32 and platform 30. In the embodiment shown in FIG. 6, a hydraulically operated elbow crane having supports 51 and 52 is provided to support swivel 18, transverse member 14 and arms 12, 12*a*. The elbow crane is preferred for stationary mounting although the scissor lift is shown in FIG. 7.

One or more nozzles 41 may be mounted on cylinder 15 to provide water, fire retardant fluids, or other materials. Water spraying nozzles may be employed to apply water directly to affected areas. Misting nozzles may be employed to mix water with the air from the blower to create a cooling fog. A lighting apparatus may also be attached to cylinder 15 to illuminate the area where the blower is pointed.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A large scale positive pressure ventilation unit for engaging a fire in a structure and ventilating gasses and smoke therefrom comprising:

a. a blower including a cylindrical housing containing a plurality of adjustable blades radially oriented about a rotatable center section for creating an airflow having a conical shape;

b. a pair of support arms for holding said blower, said arms being pivotally attached to said housing;

c. a swivel mount attached to said support arms; and d. a lift for raising and lowering said mount, arms and blower, said lift being permanently mounted to the surface of the earth.

2. The unit described in claim 1 wherein said support arms are attached to a transverse member forming a U-shaped support for said housing in which the horizontal axis of rotation runs through the pivotal attachment of both arms to the housing.

3. The unit described in claim 2 wherein said transverse member is centrally attached to said swivel at the vertical rotational axis of said U-shaped support.

4. The unit described in claim 3 wherein a hydraulic system is provided for operating said blower, mount and lift.

5. The unit described in claim 3 wherein an electrical system is provided for operating said blower, mount and lift.

6. The unit described in claim 4 wherein said lift is selected from the group of: scissors lift, scaffold lift, telescopic lift, knuckle arm, and hydraulic lift.

7. The unit described in claim 4 wherein at least one fluid spraying nozzle is provided on said housing.

8. The unit described in claim 4 wherein at least one fluid misting nozzle is provided on said housing.

9. The unit described in claim 4 wherein at least one illumination means is provided on said housing.

10. A stationary unit for engaging a fire in a structure and ventilating gasses and smoke therefrom comprising:

a. a blower including an open-ended cylindrical housing containing a plurality of adjustable blades radially oriented about a rotatable center section for creating an airflow having a conical shape;

b. a pair of support arms for holding said blower, said arms being pivotally attached to said housing;

c. a swivel mount attached to said support arms;

d. a lift for raising and lowering said mount, arms and blower; and d. a stationary platform permanently mounted to the surface of the earth, said platform being located near an opening in said structure to which said lift is mounted for supporting said lift and blower apparatus.

11. The unit described in claim 10 wherein said support arms are attached to a transverse member forming a U-shaped support for said housing in which the horizontal axis of rotation runs through the pivotal attachment of both arms to the housing.

12. The unit described in claim 11 wherein said transverse member is centrally attached to said swivel at the vertical rotational axis of said U-shaped support.

13. The unit described in claim 12 wherein a hydraulic system is provided for operating said blower, mount and lift.

14. The unit described in claim 13 wherein an electrical system is provided for operating said blower, mount and lift.

15. The unit described in claim 13 wherein said lift is selected from the group of: scissors lift, scaffold lift, telescopic lift, knuckle arm, and hydraulic lift.

16. A method for engaging a fire and ventilating gasses and smoke from a large structure comprising the steps of a. installing a stationary unit for providing positive pressure ventilation onto a platform that is permanently mounted to the surface of the earth near an air input opening of said structure, said unit comprising a ventilator having an open-ended cylindrical housing which contains a plurality of adjustable blades radially oriented about a rotatable center section for creating an airflow having conical shape, a pair of support arms pivotally attached to opposite sides of said housing and connected to a transverse member, said member attached to a swivel mount, said swivel mount attached to a lift for raising and lowering said ventilator, said lift being attached to said platform;

b. providing a separate air exit opening for said structure;

c. positioning said unit in front of said air input opening using said support arms, transverse member, swivel and lift such that the airflow created thereby covers said opening; and d. activating the ventilator of said unit to blow air into said input opening thereby forcing said gasses and smoke out through said exit opening.

* * * * *